US005815958A

United States Patent [19]

Olds et al.

[11] Patent Number: 5,815,958

[45] Date of Patent: Oct. 6, 1998

[54] EXCAVATOR DIPPER LATCH ASSEMBLY HAVING REMOVABLE TAPERED LATCH BAR

[75] Inventors: John R. Olds; Mark R. Alt, both of Carlisle, Pa.

[73] Assignee: The Frog, Switch & Manufacturing Co., Carlisle, Pa.

[21] Appl. No.: 778,206

[22] Filed: Dec. 30, 1996

[51] Int. Cl.[6] ..... E02F 3/00

[52] U.S. Cl. ..... 37/444; 37/411; 414/726

[58] Field of Search ..... 37/444, 443, 440, 37/411, 416, 431, 432, 466, 396, 401, 398; 414/726, 723

[56] References Cited

U.S. PATENT DOCUMENTS

| | | | |
|---|---|---|---|
| Re. 19,979 | 5/1936 | Bager | 37/443 X |
| 1,031,138 | 7/1912 | McKee et al. | 37/444 |
| 1,034,237 | 7/1912 | Hill . | |
| 1,077,486 | 11/1913 | Mckee | 37/444 |
| 1,131,748 | 3/1915 | Stuebner . | |
| 1,207,244 | 12/1916 | Vanderhoef . | |
| 1,566,437 | 12/1925 | Simpson | 37/444 |
| 1,745,436 | 2/1930 | Miley . | |
| 1,751,745 | 3/1930 | Miley . | |
| 1,770,543 | 7/1930 | Miley . | |
| 2,141,702 | 12/1938 | Walsh . | |
| 2,427,897 | 9/1947 | Burdick et al. . | |
| 2,735,559 | 2/1956 | Burdick et al. . | |
| 3,219,214 | 11/1965 | Baer | 37/444 |
| 3,402,486 | 9/1968 | Branson . | |
| 4,282,664 | 8/1981 | Thiele et al. . | |
| 5,042,856 | 8/1991 | Goodman | 292/259 R |
| 5,063,694 | 11/1991 | McCreary, Jr. | 37/443 X |
| 5,107,610 | 4/1992 | Fusco | 37/444 |
| 5,469,647 | 11/1995 | Profio | 37/444 X |

FOREIGN PATENT DOCUMENTS

| | | | |
|---|---|---|---|
| 848537 | 7/1981 | U.S.S.R. | 37/444 |

*Primary Examiner*—Terry Lee Melius
*Assistant Examiner*—Victor Batson
*Attorney, Agent, or Firm*—Webb Ziesenheim Bruening Logsdon Orkin & Hanson, P.C.

[57] ABSTRACT

A latch assembly for an excavator dipper of the invention includes a latch bar slot having a first opening, a second opening and a side wall. An annular projection protrudes from the latch bar slot side wall and has an upper surface and a side surface. A latch bar is slidably and removably mounted in the latch bar slot. The latch bar has a first portion, a second portion and a tapered portion located between the first and the second portion. The first portion has a larger cross-sectional area than the second portion. An upper retainer insert assembly is removably carried in the latch bar slot between the first opening and the annular projection.

20 Claims, 5 Drawing Sheets

EXCAVATOR DIPPER LATCH ASSEMBLY HAVING REMOVABLE TAPERED LATCH BAR

BACKGROUND OF THE INVENTION

1. Field of the Invention

The invention relates generally to excavator dippers and, more particularly, to a latch assembly for an excavator dipper in which the latch bar can be removed from either end of a latch bar slot.

2. Background of the Invention

In large scale digging operations, such as copper mining or moving large quantities of earth, excavators having large capacity dippers are commonly used. Typically, the dipper is formed by a hollow dipper body with a dipper door pivotally attached to the bottom of the dipper body. Such large scale dippers commonly weigh on the order of many tons. A latch mechanism is used to lock the dipper door in a closed position against the bottom of the dipper body during the digging stroke of the dipper. To unload the dipper, the latch mechanism is disengaged. The dipper door then swings open and the contents of the dipper fall through the open bottom of the dipper body. The dipper door is then swung back to its closed position and the latch mechanism reengaged in preparation for the next digging stroke.

U.S. Pat. No. 2,735,559 to Burdick et al. discloses a dipper body having a pivotally mounted dipper door. The dipper door is held in the closed position by an elongated, substantially straight latch bar slidably carried in a latch bar slot. In the closed position, the latch bar extends into a latch keeper slot on the dipper body. A latch lever is attached to one end of the latch bar. To open the door, the outer end of the latch lever is pulled by a latch cable which causes the inner end of the latch lever to pivot around a bracket. As the latch lever pivots, the latch bar is pulled out of the latch keeper slot to allow the dipper door to swing open.

Because of the massive weight of the latch mechanism and door components in larger dippers, it is expedient to limit the weight of the latch bar to decrease the throw away weight of the latch bar and to help decrease the wear on the latch bar. Therefore, dippers having tapered latch bar slots and spade-shaped latch bars have been developed. One such dipper and latch mechanism is manufactured by the Frog, Switch & Manufacturing Company of Carlisle, Pa. In this dipper, the dipper door has a tapered slot which is wider at the front end of the door than at the rear end of the door. The latch mechanism includes a tapered latch bar slidable within the tapered slot in the dipper door. The latch bar is substantially spade-shaped with a wide portion and a narrow portion. The wide portion of the latch bar engages a latch keeper slot in the heelband of the dipper to hold the dipper door closed. Use of a tapered latch bar greatly reduces the weight of the latch bar. An elongated latch lever passes through a slot in the latch bar. A latch lever bracket is attached to the outer surface of the dipper door and a substantially C-shaped latch lever retainer is held in the latch lever bracket by a retainer bolt. The latch lever has a pair of spaced-apart expanded portions, with one expanded portion located at the end of the latch lever that engages the latch lever retainer. The other end of the latch lever has a hole which is connected to a latch cable. A single piece, rectangular wear insert is located in the upper, narrow portion of the latch bar slot. An additional wear insert is located at the lower end of the latch bar slot.

To unlock this dipper door during operation, the latch cable is pulled which causes the latch lever to pivot around the end of the latch lever held in the latch lever retainer. As the latch lever pivots, the latch lever pulls the latch bar towards the rear of the dipper door thereby withdrawing the wide end of the latch bar from the latch keeper slot.

After repeated use, the wear inserts and the surface of the latch bar become worn to the point where the wear inserts or latch bar must be replaced in order to allow smooth operation of the latch mechanism. However, in order to replace the worn latch bar of this known latch mechanism, the dipper door must be hoisted by an auxiliary crane to an open position substantially parallel to the ground. The latch lever is disengaged from the latch lever retainer and is pulled outwardly through the slots in the latch bar and the dipper door. However, because of the tapering of the latch bar and latch bar slot, the latch bar can only be removed by pulling the latch bar forward towards the front of the open dipper door.

In large dippers, the dipper door weighs on the order of 35,000 to 40,000 pounds and the latch bar itself may weigh on the order of 2,000 pounds. Thus, because the dipper door must be hauled to an opened position and held there in order to remove the worn latch bar, the workers removing the worn latch bar are placed in a dangerous situation around the open dipper door. If the auxiliary crane holding the dipper door open should fail and the multi-ton dipper door swing closed, the workers removing the worn latch bar could be seriously injured. Further, hauling open and holding the dipper door each time a worn latch bar must be replaced is a very time consuming operation which adversely impacts upon the available operational time of the dipper. Additionally, to insert a new latch bar into the latch bar mechanism, the dipper door must remain open and the new latch bar must be moved substantially horizontally into the tapered latch bar slot, which also is a dangerous operation for the workers tasked with this job.

Therefore, it is an object of the present invention to provide a latch assembly for an excavator dipper in which the dipper door need not be hoisted to an open position in order to remove and replace a worn latch bar.

SUMMARY OF THE INVENTION

A latch assembly for an excavator dipper of the invention includes a latch bar slot having a first opening, a second opening and a side wall. A projection protrudes from the latch bar slot side wall and has an upper surface and a side surface. A latch bar is slidably and removably mounted in the latch bar slot. The latch bar has a first portion, a second portion and a tapered portion located between the first and the second portion. The first portion is larger than the second portion. An upper retainer insert assembly is removably carried in the latch bar slot between the first opening and the projection.

A complete understanding of the invention will be obtained from the following description when taken in connection with the accompanying drawing figures wherein like reference characters identify like parts throughout.

DESCRIPTION OF THE PREFERRED EMBODIMENT

Figure 1:
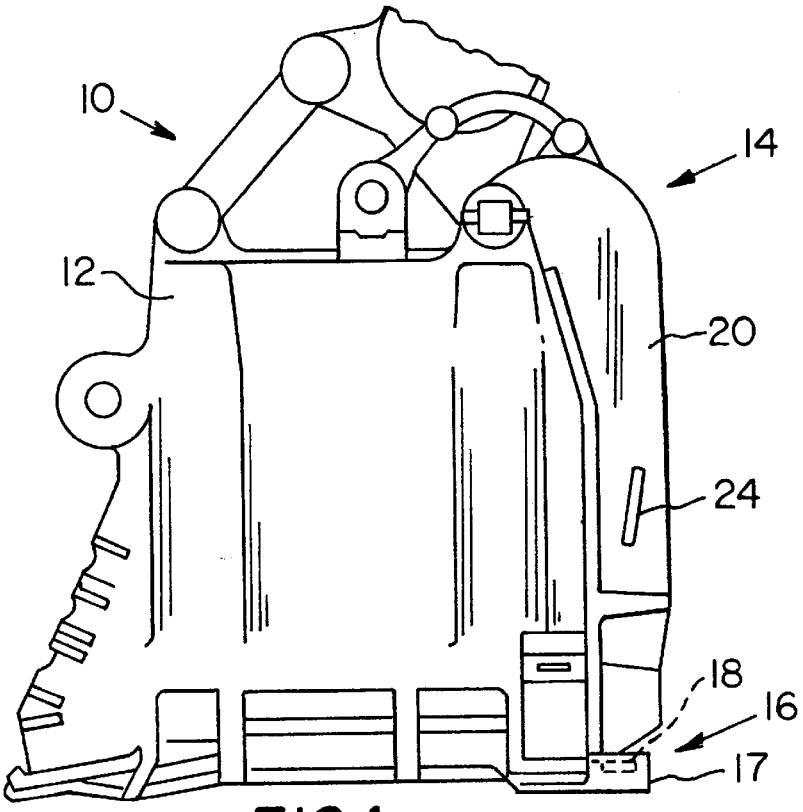
FIG. 1 is a side view of an excavator dipper of the invention.

For purposes of the description hereinafter, the terms "upper", "lower", "right", "left", "top", "bottom", "side", "vertical", "horizontal" and derivatives thereof shall relate to the invention as it is oriented in the drawing figures. However, it is to be understood that the invention may assume various alternative orientations and step sequences, except where expressly specified to the contrary. It is also to be understood that the specific devices; and processes illustrated in the attached drawings, and described in the following specification, are exemplary embodiments of the inventive concepts defined in the appended claims. Hence, the specific dimensions and other physical characteristics relating to the embodiments disclosed herein are not to be considered as limiting, unless the claims expressly state to the contrary.

Figure 2:
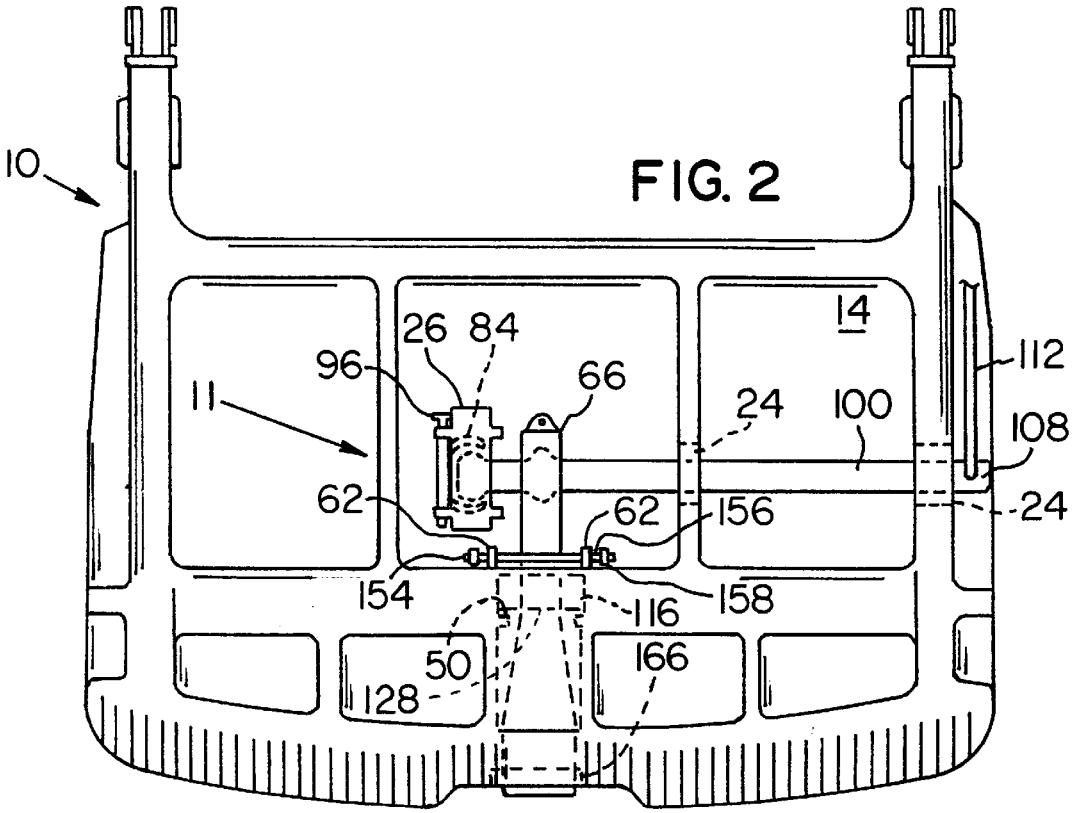
FIG. 2 is a rear view of the dipper shown in FIG. 1 showing a dipper latch assembly of the invention.

A dipper in accordance with the invention is generally designated 10 in FIGS. 1 and 2 of the drawings. A latch assembly in accordance with the invention is generally designated 11 in FIG. 2 of the drawings. The dipper 10 includes a substantially rectangular, hollow dipper body 12 which is open at both ends. A substantially rectangular dipper door 14 is pivotally mounted on the dipper body 12. The dipper door 14 is moveable from a closed position shown in FIG. 1 of the drawings, in which the dipper door 14 closes off the bottom of the dipper body 12, to an open position in which the dipper door is pivoted away from the bottom of the dipper body 12. The dipper body 12 has a heelband 16 which includes a latch keeper 17 defining a latch keeper slot 18.

Figure 3:
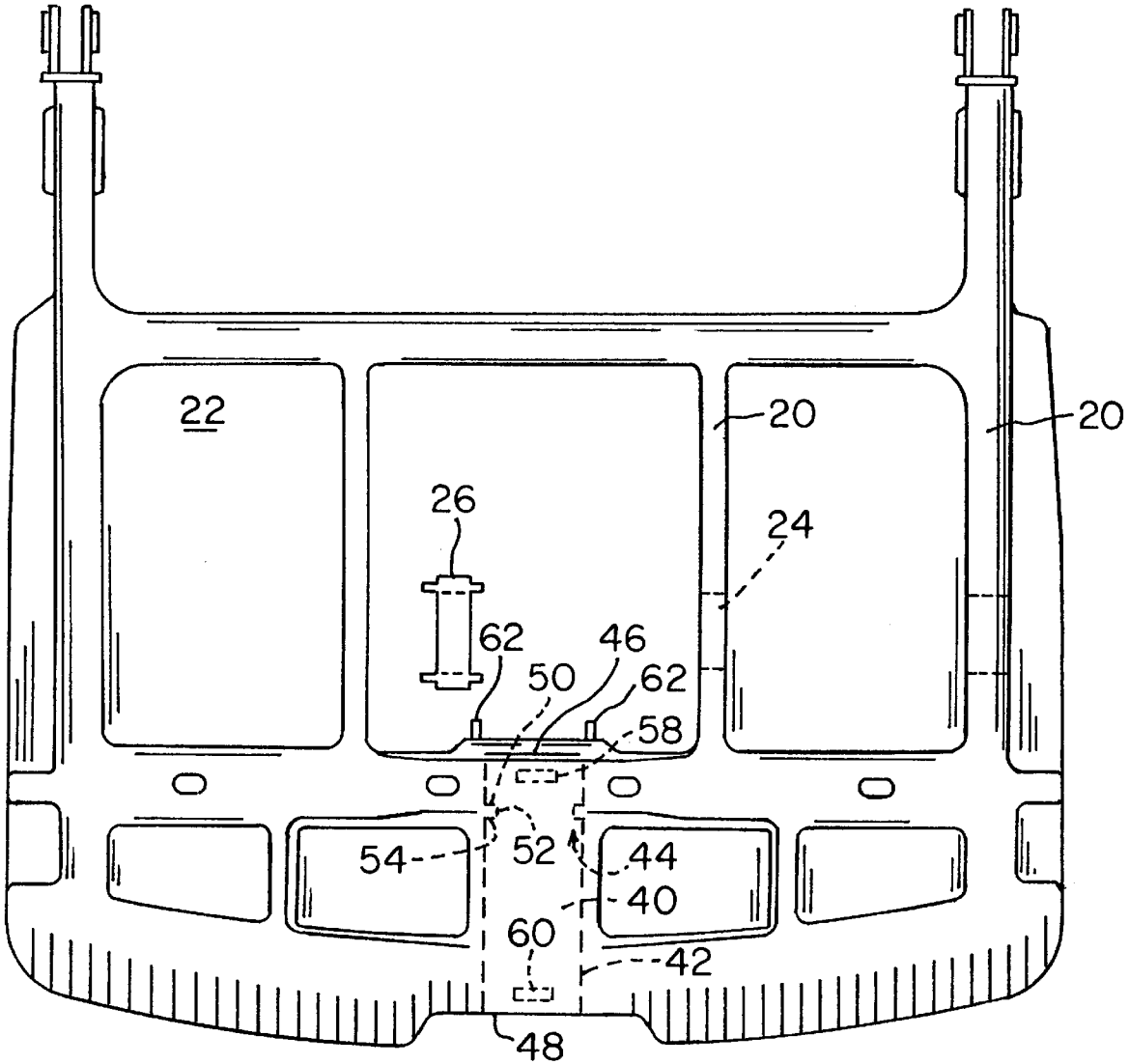
FIG. 3 is a rear view of a dipper door with the latch bar and latch lever removed.
Figure 4:
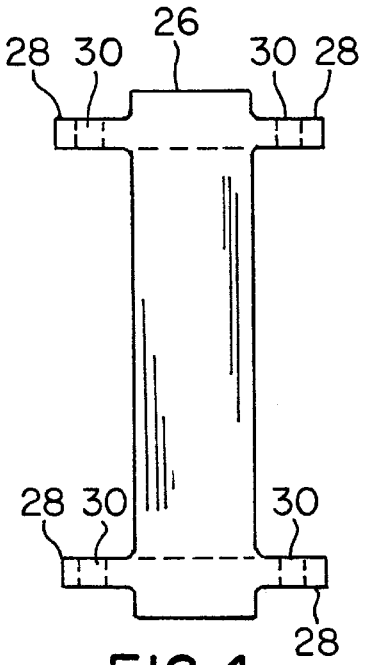
FIG. 4 is a side view of a latch lever block of the latch assembly.
Figure 5:
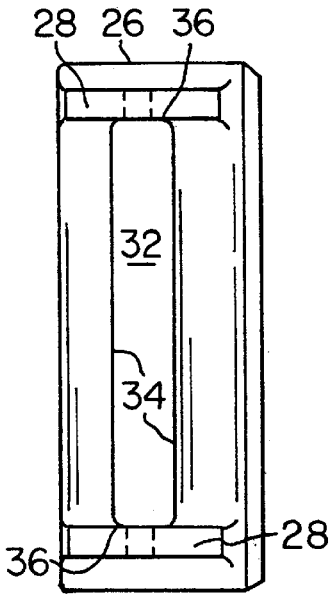
FIG. 5 is an end view of the latch lever block shown in FIG. 4.

As shown in FIGS. 1 and 3 of the drawings, the dipper door 14 includes a plurality of support ribs 20 attached to an outer surface 22 of the dipper door 14. Several of the support ribs 20 have elongated slots 24 formed therein. As shown in FIG. 2 of the drawings, the latch assembly 11 includes a latch lever block 26 attached to the outer surface 22 of the dipper door 14. As shown in FIGS. 4 and 5 of the drawings, the latch lever block 26 is substantially rectangular and has at least one pair of spaced-apart tabs 28 extending therefrom. Each tab 28 includes a bore 30. The latch lever block 26 includes an elongated, substantially rectangular slot 32 extending therethrough. The slot 32 has a pair of opposed side walls 34 and a pair of opposed end walls 36.

As shown in FIG. 3 of the drawings, the latch assembly 11 further includes a latch bar slot 40 formed in the dipper door 14. The latch bar slot 40 is substantially rectangular and includes a slot wall 42 with an annular projection 44 protruding from the slot wall 42. The slot 40 has a first or upper opening 46 and a second or lower opening 48. The projection 44 is substantially rectangular and includes an upper surface 50, side surface 52 and lower surface 54. At least one upper recess 58 is located in the slot wall 42 between the upper surface 50 of the projection 44 and the upper opening 46. A pair of opposed lower recesses 60 are located between the lower surface 54 of the projection 44 and the lower opening 48. A pair of spaced-apart eyelets 62 is attached to the outer surface 22 of the dipper door above the upper opening 46.

Figure 6:
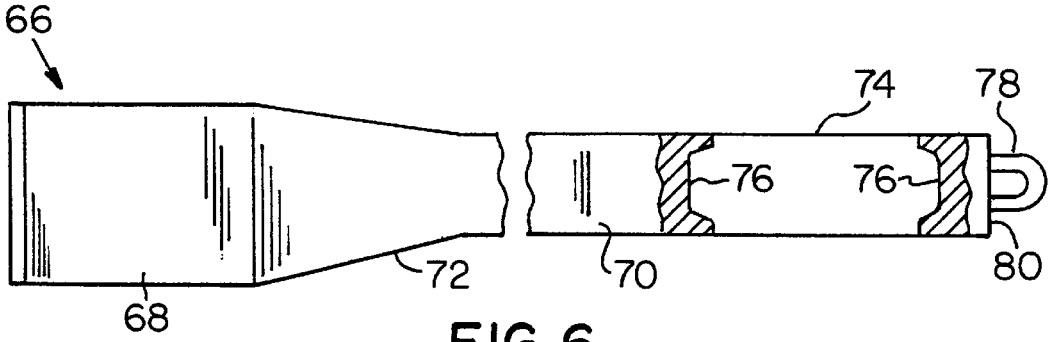
FIG. 6 is a plan view of a latch bar of the invention.
Figure 7:
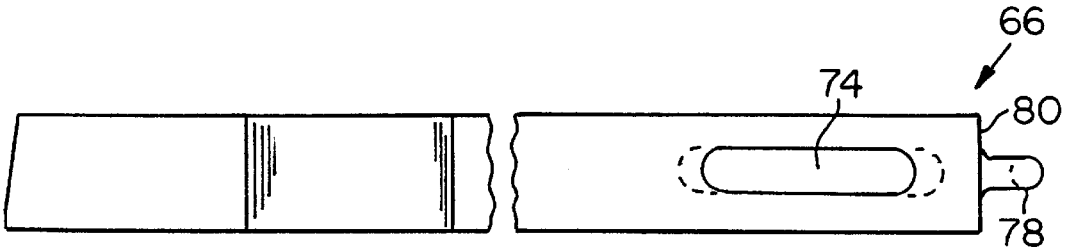
FIG. 7 is a side view of the latch bar shown in FIG. 6.

As shown in FIGS. 2, 6 and 7 of the drawings, the latch assembly 11 includes a substantially spade-shaped latch bar 66 removably and slidably carried in the latch bar slot 40. The latch bar 66 has a first or wide portion 68, an elongated second or narrow portion 70 and a tapered portion 72 located between the wide portion 68 and the narrow portion 70. The wide portion 68 has a larger cross-sectional area than that of the narrow portion 70. The upper surface of the wide portion 68 of the latch bar 66 is chamfered to facilitate the re-engagement of the latch bar 66 with the latch keeper slot 18 when the dipper door 14 swings closed. The latch bar further includes a slot 74 having two opposed recesses 76 extending transversely through the narrow portion 70 of the latch bar 66. A lifting eye 78 is attached to a narrow end 80 of the latch bar 66 remote from the wide portion 68.

Figure 8:
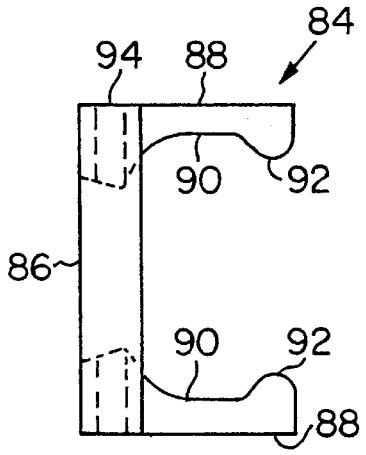
FIG. 8 is a side view of a latch lever retainer of the invention.
Figure 9:
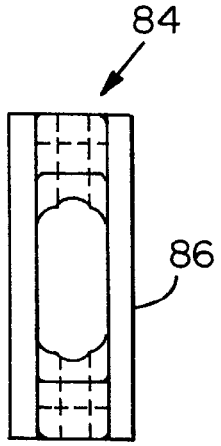
FIG. 9 is an end view of the latch lever retainer shown in FIG. 8.

As shown in FIGS. 2, 8 and 9 of the drawings, a latch lever retainer 84 is removably carried in the latch lever block 26. The latch lever retainer 84 is substantially C-shaped and has a substantially rectangular base 86 with two holding members 88 extending substantially perpendicularly from the base 86. Each holding member 88 includes a curved inner surface 90 with a lip 92 formed on the end of the inner surface 90 remote from the base 86. A bore 94 extends longitudinally through the base 86. As shown in FIG. 2 of the drawings, the latch lever retainer 84 is removably connected to the latch lever block 26 by a retainer bolt 96 which passes through the bores 30 in the latch lever block tabs 28 and the bore 94 in the latch lever retainer base 86. The retainer bolt 96 may be held in place by a nut removably attached to one end of the retainer bolt 96.

Figure 10:
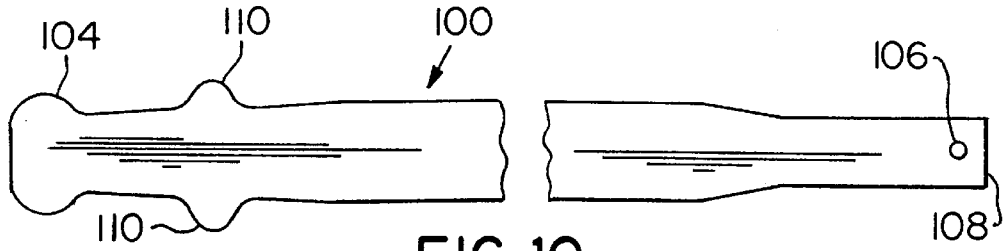
FIG. 10 is a plan view of a latch lever of the invention.

As shown in FIGS. 2 and 10 of the drawings, the latch assembly 11 further includes a latch lever 100. The latch lever 100 is substantially rectangular but includes a rounded end 104. A bore 106 is located at an end 108 of the latch lever 100 remote from the rounded end 104. The latch lever 100 further includes two intermediate projections 110 spaced from the rounded end 104 of the latch lever 100. As shown in FIG. 2 of the drawings, the latch lever 100 extends through the slots 24 in the support ribs 20 and through the slot 74 in the latch bar 66. The rounded end 104 of the latch lever 100 is pivotally held in the latch lever retainer 84 which is itself carried in the latch lever block 26. The curves of the intermediate projections 110 are complementary to the curves of the recesses 76 in the latch bar slot 74. A cable 112 is attached to the outer end of the latch lever 100 through the bore 106.

Figure 14:
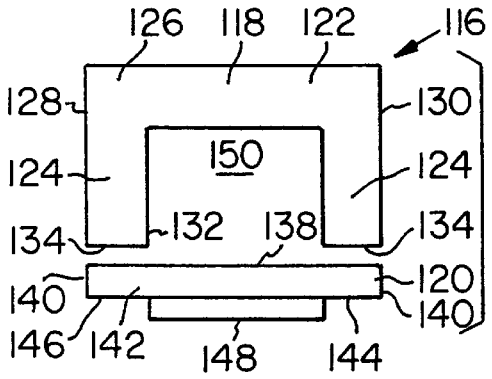
FIG. 14 is an end view of an upper retainer insert assembly.
Figure 11:
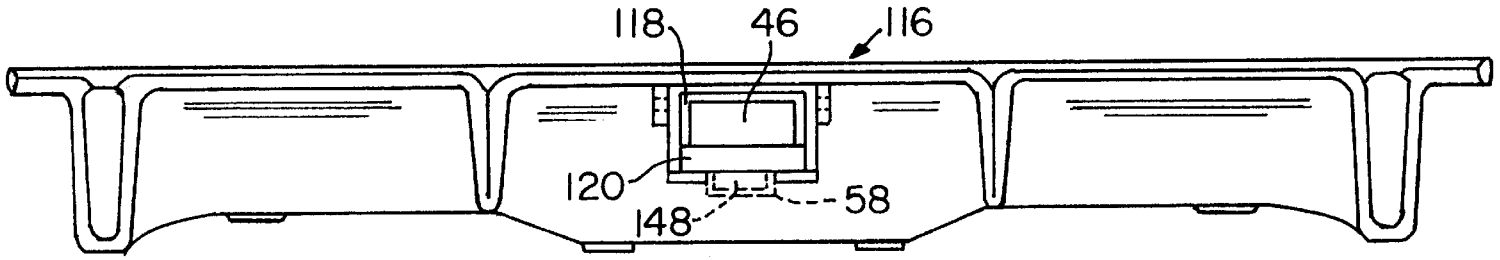
FIG. 11 is a top view of a dipper door latch bar slot.

As shown in FIGS. 2, 11 and 14, the latch assembly 11 further includes an upper retainer insert assembly 116 located in the latch bar slot 40 between the upper opening 46 and the annular projection 44. As shown in FIG. 14 of the drawings, the upper retainer insert assembly 116 includes a substantially C-shaped member 118 and a substantially straight member 120. The C-shaped member 118 includes a base 122 having a pair of legs 124 extending substantially perpendicularly therefrom. The C-shaped member 118 has a top surface 126, a bottom surface 128, an outer surface 130 and an inner surface 132. Each leg 124 includes an outer end 134. The straight member 120 is substantially rectangular and has an inner surface 138, a pair of opposed side surfaces 140, a top surface 142, a bottom surface 144 and an outer surface 146. A substantially rectangular tab 148 is attached to the outer surface 146 of the straight member 120. The tab 148 of the straight member 120 extends into the upper recess 58 in the latch bar slot 40 and the bottom surface 144 of the straight member 120 rests on the upper surface 50 of the annular projection 44. The C-shaped member 118 is positioned opposite the straight member 120 with the bottom surface 128 of the C-shaped member resting on the upper surface 50 of the projection 44 and the outer ends 134 of each leg 124 adjacent the inner surface 138 of the straight member 120. A portion of the bottom surface 128 of the C-shaped member 118 and the bottom surface 144 of the straight member 120 extend beyond the side surface 52 of the projection 44. The upper retainer wear insert assembly 116 defines a passage 150 having a cross-sectional area slightly larger than that of the narrow portion 70 of the latch bar 66 such that the narrow portion 70 is slidable through the passage 150. However, the passage 150 is not large enough for the wide portion 68 to pass through.

A retainer rod 154 is removably carried in the eyelets 62. The retainer rod 154 is substantially cylindrical and has threads 156 located at each end of the retainer rod 154. The retainer rod 154 is held in place by nuts 158 which engage the threads 156 on the ends of the retainer rod 154. The retainer rod 154 prevents the C-shaped member 118 from falling out of the latch bar slot 40 during operation of the dipper 10.

Figure 13:
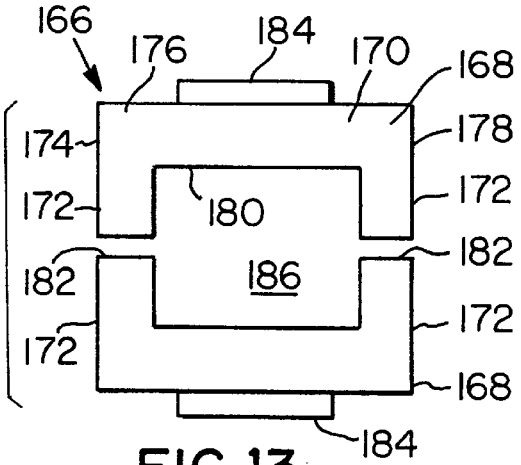
FIG. 13 is an end view of a lower wear insert assembly.
Figure 12:
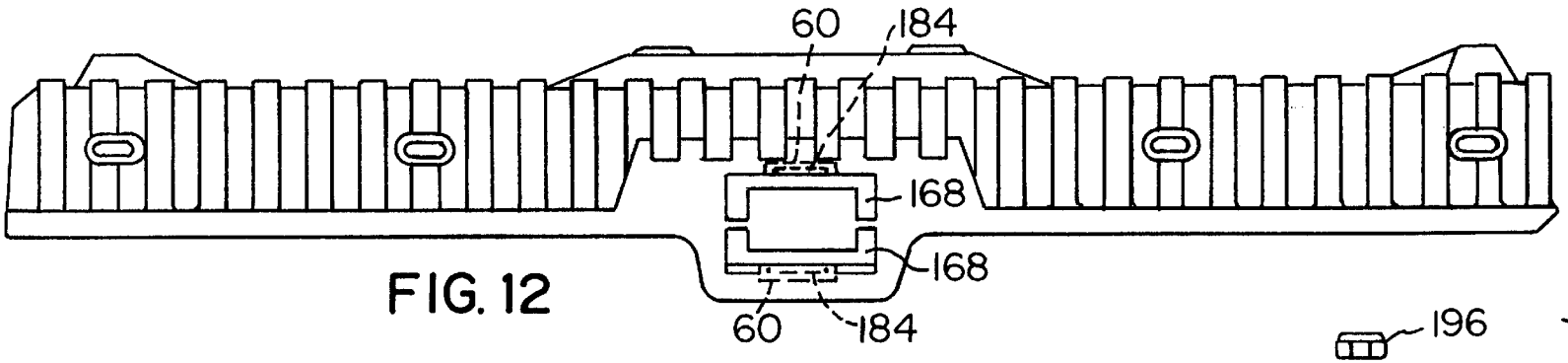
FIG. 12 is a bottom view of the latch bar slot.

As shown in FIGS. 2, 12 and 13, the latch assembly also includes a lower wear insert assembly 166. The lower wear insert assembly 166 includes two substantially C-shaped lower wear inserts 168. Each lower wear insert 168 includes a substantially rectangular base 170 with a pair of legs 172 extending perpendicularly therefrom. Each lower wear insert 168 includes a bottom surface 174, a top surface 176, an outer surface 178 and an inner surface 180. Each leg 172 has an end surface 182. A tab 184 is attached to the outer surface 178 of the base 170. The lower wear inserts 168 are located in the latch bar slot 40 near the lower opening 48. The tab 184 of each lower wear insert 168 engages one of the recesses 60 in the slot wall 42. The lower wear insert assembly 166 defines a passage 186 large enough for the wide portion 68 of the latch bar 66 to pass through.

Figure 16:
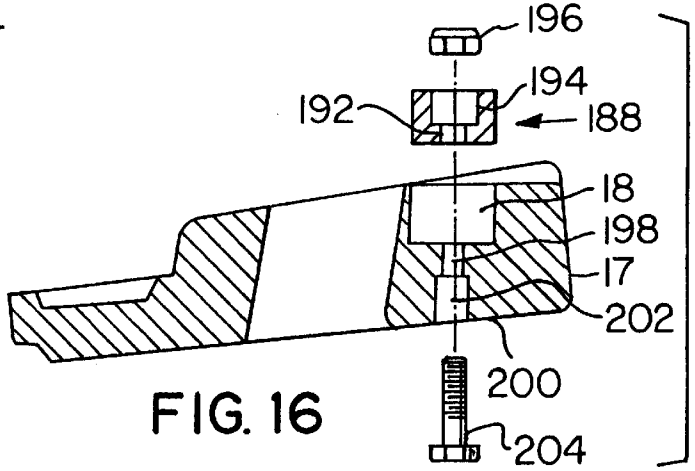
FIG. 16 is an expanded, sectional view of the latch keeper insert.
Figure 15:
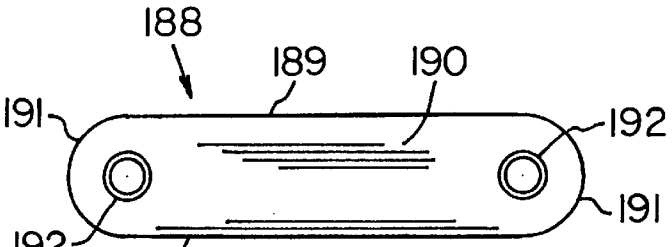
FIG. 15 is a plan view of a latch keeper insert of the invention.

As shown in FIGS. 15 and 16 of the drawings, the latch assembly 11 further includes a latch keeper insert 188 removably carried in the latch keeper slot 18. The latch keeper insert 118 is preferably substantially rectangular with fully radiused ends. The latch keeper insert 118 has a pair of substantially straight sides 189, a substantially planar top surface 190, a pair of curved ends 191 and a pair of spaced-apart bolt holes 192. As shown in FIG. 16 of the drawings, the portion 194 of each bolt hole 192 adjacent the top surface 190 is countersunk to receive a nut 196. The latch keeper 17 has a bolt hole 198 extending from the bottom of the latch keeper slot 18 to the bottom 200 of the latch keeper 17. The outer portion 202 is countersunk to receive the head of a bolt 204. In the assembled configuration, the latch keeper 188 is located at the bottom of the latch keeper slot 18 and is held in place by a pair of bolts 204 and nuts 196.

Operation of the dipper and latch assembly will now be described. In the engaged position, the wide end 82 of the latch bar 66 extends through the lower opening 48 and engages the latch keeper slot 18 to hold the dipper door 14 in the closed position during the digging stroke. In order to disengage the latch assembly, the cable 112 is pulled which moves the end 108 of the latch lever 100 towards the rear of the dipper door 14. The latch lever 100 pivots around the rounded end 104 held in the latch lever retainer 84. As the latch lever 100 pivots, the upper intermediate projection 110 engages the upper recess 76 in the slot 74 of the latch bar 66 which pulls the latch bar 66 toward the rear of the dipper door 14. As the latch bar 66 moves through the latch bar slot 40, the narrow portion 70 of the latch bar slides between the inner surface 132 of the C-shaped member 118 and the inner surface 138 of the straight member 120. Thus, the upper retainer insert assembly 116 provides a wear surface for the narrow portion 70 of the latch bar 66. Additionally, the passage 150 formed by the upper wear insert assembly 116 permits a spade-shaped latch bar 66 to be used thereby greatly reducing the weight of the latch bar 66. Thus, the upper retainer insert assembly 116 functions as both a wear surface and as a retainer for the latch bar 66.

When the wide end 82 of the latch bar 66 is pulled from the latch keeper slot 18, the dipper door 14 pivots to the open position to dump the contents of the dipper body 12. After dumping, the dipper 10 is positioned such that the force of gravity swings the dipper door 14 back toward the bottom of the dipper body 12. The chamfered top of the latch bar 66 slides over the rounded outer surface of the heelband 16 until the wide end 82 of the latch bar 66 reengages the latch keeper slot 18. The latch bar 66 slides into the latch keeper slot 18 until the wide end 82 of the latch bar 66 strikes the top surface 190 of the latch keeper insert 188 between the two bolt holes 192 to lock the dipper door 14 in the closed position.

After repeated opening and closing of the dipper door 14, the surfaces of the upper retainer insert assembly 116, lower wear insert assembly 166 and, eventually, the latch bar 66 itself become worn to the point where these components must be replaced. To replace the upper retainer insert assembly 116, the retainer bolt 96 is removed and the latch lever retainer 84 and latch lever 100 are moved toward the left, as shown in FIG. 2, until the latch lever retainer 84 is completely outside the slot 32 in the latch lever block 26. The latch lever retainer 84 is then moved laterally to disengage the rounded end 104 of the latch lever 100. The latch lever 100 can then be pulled to the right, as shown in FIG. 2, through the slot 74 in the latch bar 66 and the slots 24 in the support ribs 20, to be completely removed from the dipper door 14. The nuts 158 are removed from the threads 156 of the retainer rod 154 and the retainer rod 154 is pulled laterally out of the eyelets 62. An auxiliary crane is attached to the lifting eye 78 on the narrow end 80 of the latch bar 66 and the latch bar 66 pulled upwardly through the latch bar slot 40. When the tapered portion 72 of the latch bar 66 engages the bottom surface 128 of the C-shaped member 118, further upward movement of the latch bar 66 will lift the C-shaped member 118 out of the latch bar slot 40. The C-shaped member 118 can then simply be removed from the tapered portion 72 of the latch bar 66. The straight member 120 can then also be removed by withdrawing the tab 148 from the upper recess 58 and lifting the straight member 120 out of the latch bar slot 40. A new straight member 120 can then be inserted into the latch bar slot 40 and a new C-shaped member 118 placed on the tapered portion 72 of the latch bar 66. The latch bar 66 is then lowered back into the latch bar slot 40 and the retainer rod 154 replaced.

The latch lever 100 is replaced by inserting the rounded end 104 of the latch lever 100 through the slots 24 in the support ribs 20, the slot 74 in the latch bar 66 and through the slot 32 of the latch lever block 26. The latch lever retainer 84 is then placed around the rounded end 104 of the latch lever 100 and the retainer 84 and latch lever 100 are moved toward the right, as shown in FIG. 2 of the drawings, until the latch lever retainer is again within the slot 32 of the latch lever block 26. The retainer bolt 96 is then reinserted through the bores 30 in the latch lever block 26 and bore 94 in the latch lever retainer 84.

To remove the lower wear insert assembly 166, the latch bar 66 is lifted, as described above, until the wide portion 68 of the latch bar 66 is above the lower wear inserts 168. The dipper door 14 is opened a small amount, i.e., about 10°–15°. The lower wear inserts 168 are then simply removed one at a time and replaced and the latch bar 66 lowered back into position.

To replace a worn latch keeper insert 188, the nuts 196 are removed and the worn latch keeper insert 188 lifted out of the top of the latch keeper slot 18. A new latch keeper insert 188 is then placed in the latch keeper slot 18 and the nuts 196 replaced.

To remove the latch bar 66, the latch lever 100 is removed as discussed hereinabove. An auxiliary crane is connected to the lifting eye 78. The worn latch bar 66 can then simply be lifted vertically out of the latch bar slot 40 and moved to a staging area. A new latch bar 66 can then be vertically inserted into the latch bar slot 40 and the upper retainer insert assembly 116 and latch lever 100 replaced. Thus, with the latch assembly 11 of the present invention, the dipper door 14 does not have to be held open during replacement of the latch bar 66. Further, the entire latch assembly can be disassembled and reassembled with the dipper door positioned substantially vertically. The ability to disassemble and reassemble the entire latch assembly without having to hold the dipper door 14 open more than about 10°–15° is a significant safety improvement over previous latch assembly structures. The latch assembly structure of the present invention not only includes a tapered, reduced weight latch bar 66 but also allows the latch assembly 11 to be assembled and disassembled with the dipper door 14 in the closed position.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiment described in detail herein is illustrative only and is not limiting to the scope of the invention which is to be given the full breadth of the appended claims and any and all equivalents thereof.

We claim:

1. A latch assembly for an excavator dipper, the latch assembly comprising:

a latch bar slidably and removably carried in a latch bar slot, the latch bar having a first portion and a second portion, with the first portion being larger than the second portion; and a retainer insert assembly removably carried in the latch bar slot, wherein the latch bar slot defines a passage larger than the first portion of the latch bar, and wherein the retainer insert assembly defines a passage larger than the second portion of the latch bar and smaller than the first portion of the latch bar such that the first portion of the latch bar cannot pass through the retainer insert assembly when the retainer insert assembly is located in the latch bar slot.

2. A latch assembly for an excavator dipper, comprising:

a latch bar slot, said latch bar slot having a first opening, a second opening and a side wall;

a projection protruding from said latch bar slot side wall;

a latch bar slidably and removably carried in said latch bar slot, said latch bar having a first portion and a second portion, with said first portion being larger than said second portion; and a retainer insert assembly removably carried in said latch bar slot between said first opening and said projection, wherein said projection defines an inner passage larger than said first portion of said latch bar.

3. A latch assembly as claimed in claim 2, wherein said retainer insert assembly defines a passage larger than said second portion of said latch bar and smaller than said first portion of said latch bar.

4. A latch assembly as claimed in claim 2, including a wear insert assembly removably carried in said latch bar slot between said projection and said second opening.

5. A latch assembly as claimed in claim 4, wherein said wear insert assembly includes a pair of substantially C-shaped elements having a base and a rear surface, with a tab extending from said rear surface of each said C-shaped element.

6. A latch assembly as claimed in claim 5, wherein said latch bar slot includes a pair of opposed recesses located in said side wall of said latch bar slot between said projection and said second opening and said tabs of said C-shaped elements are configured to engage said recesses.

7. A latch assembly as claimed in claim 2, wherein said projection is an annular projection.

8. A latch assembly for an excavator dipper, comprising:

a latch bar slot, said latch bar slot having a first opening, a second opening and a side wall;

a projection protruding from said latch bar slot side wall;

a latch bar slidably and removably carried in said latch bar slot, said latch bar having a first portion and a second portion, with said first portion being larger than said second portion;

a retainer insert assembly removably carried in said latch bar slot between said first opening and said projection, wherein said retainer insert assembly includes a substantially C-shaped member having a base, an inner surface, a bottom surface and a pair of legs extending substantially perpendicularly from said base; and a substantially straight member having an inner surface and an outer surface, with a tab extending from said outer surface of said straight member.

9. A latch assembly as claimed in claim 8, wherein said latch bar slot includes at least one recess located in said side wall of said latch bar slot between said first opening and said projection and said tab of said straight member is configured to engage said recess.

10. A latch assembly as claimed in claim 8, wherein said legs of said C-shaped member have ends which substantially abut said inner surface of said straight member.

11. A latch assembly as claimed in claim 3, wherein said C-shaped member is positioned opposite said straight member with said bottom surfaces of said C-shaped member and said straight member abutting an upper surface of said projection.

12. A latch assembly for an excavator dipper, comprising:

a latch bar slot, said latch bar slot having a first opening, a second opening and a side wall;

a projection protruding from said latch bar slot side wall;

a latch bar slidably and removably carried in said latch bar slot, said latch bar having a first portion and a second portion, with said first portion being larger than said second portion;

a retainer insert assembly removably carried in said latch bar slot between said first opening and said projection; and a latch keeper having a latch keeper slot with a latch keeper insert removably carried in said latch keeper slot.

13. A latch assembly for an excavator dipper, comprising:

a latch bar slot, said latch bar slot having a first opening, a second opening and a side wall;

a projection protruding from said latch bar slot sidewall, said projection having an upper surface and a side surface;

a latch bar slidably and removably carried in said latch bar slot, said latch bar having a first portion, a second portion and a tapered portion located between said first and second portions with said first portion having a larger cross-sectional area than said second portion; and an upper retainer insert assembly removably carried in said latch bar slot between said first opening and said projection, wherein said upper retainer insert assembly defines a passage having a cross-sectional area larger than that of said second portion of said latch bar and smaller than that of said first portion of said latch bar and wherein said upper retainer insert assembly includes a substantially C-shaped member having a base, an inner surface, a bottom surface and a pair of legs extending substantially perpendicularly from said base and said upper retainer insert assembly further includes a substantially straight member having an inner surface and an outer surface, with a tab extending from said outer surface of said straight member.

14. A latch assembly as claimed in claim 13, wherein said latch bar slot includes at least one recess located in said side wall of said latch bar slot between said first opening and said projection and said tab of said straight member is configured to engage said recess.

15. A latch assembly as claimed in claim 13, wherein said legs of said C-shaped member have ends which substantially abut said inner surface of said straight member.

16. A latch assembly as claimed in claim 13, wherein said C-shaped member is positioned opposite to said straight member with said bottom surfaces of said C-shaped member and said straight member abutting said upper surface of said projection and with a portion of said C-shaped member and said straight member extending beyond said side surface of said projection.

17. A latch assembly as claimed in claim 13, wherein said projection defines an inner passage having a cross-sectional area which is larger than the cross-sectional area of said first portion of said latch bar.

18. A latch assembly as claimed in claim 13, wherein said lower wear insert assembly includes a pair of substantially C-shaped elements having a base and a rear surface, with a tab extending from said rear surface of each said C-shaped element.

19. A latch assembly as claimed in claim 18, wherein said latch bar slot includes a pair of opposed recesses located in said side wall of said latch bar slot between said projection and said second opening and said tabs of said C-shaped elements engage said recesses.

20. A latch assembly for an excavator dipper, comprising:

a latch bar slot, said latch bar slot having a first opening, a second opening and a sidewall;

an annular projection protruding from said latch bar slot side wall, said annular projection having an upper surface and a side surface;

a latch bar slidably and removably carried in said latch bar slot, said latch bar having a first portion, a second portion and a tapered portion located between said first and second portions, with said first portion having a larger cross-sectional area than said second portion;

an upper retainer insert assembly removably carried in said latch bar slot between said first opening and said annular projection, wherein said upper retainer insert assembly includes a substantially C-shaped member having a base, an inner surface, a bottom surface and a pair of legs extending substantially perpendicularly from said base and a substantially straight member having an inner surface and an outer surface, with a tab attached to said outer surface of said straight member;

at least one upper recess located in said side wall of said latch bar slot between said first opening and said annular projection, said tab of said straight member configured to engage said upper recess;

a lower wear insert assembly located in said latch bar slot between said annular projection and said second opening, wherein said lower wear insert assembly includes a pair of substantially C-shaped elements having a base and a rear surface, with a tab extending from said rear surface of each said C-shaped element;

a pair of opposed lower recesses located in said side wall of said latch bar slot between said annular projection and said second opening, wherein said tabs of said C-shaped elements are configured to engage said opposed lower recesses; and a latch keeper having a latch keeper slot with a latch keeper insert removably carried in said latch keeper slot, wherein said annular projection defines a passage having a cross-sectional area larger than said cross-sectional area of said first portion of said latch bar.

* * * * *